United States Patent [19]

Awalt, Jr.

[11] Patent Number: 4,528,929

[45] Date of Patent: Jul. 16, 1985

[54] ANCHOR HANDLING AND STORAGE DEVICE

[75] Inventor: Thomas Y. Awalt, Jr., Pensacola, Fla.

[73] Assignee: Deep Seven Company, Pensacola, Fla.

[21] Appl. No.: 520,483

[22] Filed: Aug. 4, 1983

Related U.S. Application Data

[60] Continuation-in-part of Ser. No. 413,727, Sep. 1, 1982, abandoned, which is a division of Ser. No. 216,063, Dec. 12, 1980, abandoned.

[51] Int. Cl.[3] ..... B63B 21/22

[52] U.S. Cl. ..... 114/210

[58] Field of Search ..... 114/210, 293, 310

[56] References Cited

U.S. PATENT DOCUMENTS 2,734,475 2/1956 Fyock ..... 114/210
3,785,323 1/1974 Lantz ..... 114/210
3,974,793 8/1976 Aring ..... 114/210
4,058,074 11/1977 Hungerford ..... 114/210

*Primary Examiner*—Sherman D. Basinger

[57] ABSTRACT

A handling and storage device for a swivel-fluke-type marine anchor comprises an interrelated shank-receiving boom and fluke-receiving guide both being rotatable with parallel axes of rotation. When the shank of the anchor is held in position by the shank-receiving boom, the fluke-receiving guide receives and folds the anchor into an essentially planar position. In a preferred embodiment suitable for overhanging sides and transoms, the axes of rotation of both the shank-receiving boom and the fluke-receiving guide is the same. In another preferred embodiment suitable for vertical or receding sides and transoms the axes are separate but parallel, and the axis of the boom is on a frame which is also rotatable and which holds the boom away from the side or transom when in the receiving position.

4 Claims, 7 Drawing Figures

ANCHOR HANDLING AND STORAGE DEVICE

Figure 1:
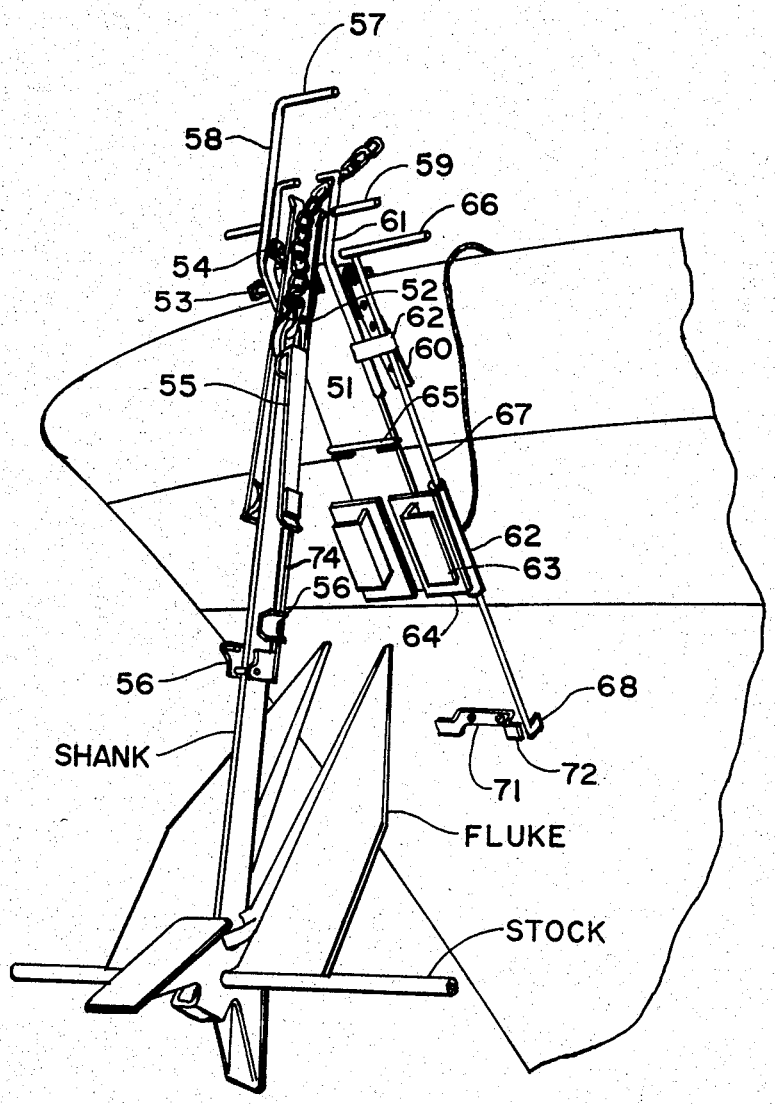
Figure 2:
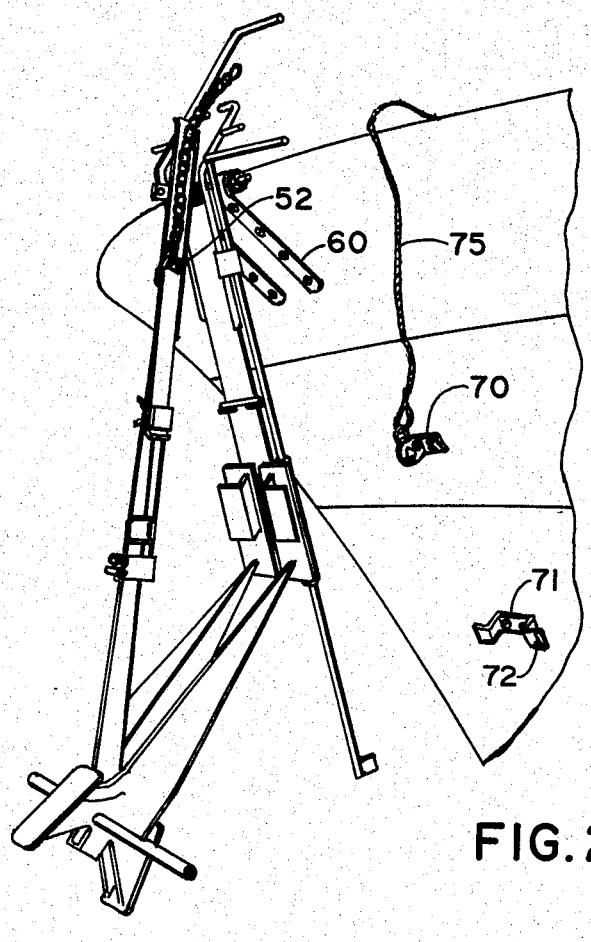

This is a continuation-in-part of my copending application Ser. No. 413,727, filed Sept. 1, 1982, now abandoned, which is a division of application Ser. No. 216,063, filed Dec. 12, 1980, now abandoned.

FIELD OF THE INVENTION

The invention relates to marine anchor handling and stowage devices, particularly those for swivel-fluke-type anchors.

BACKGROUND OF THE INVENTION

The light weight swivel-fluke-type anchor, most noted and successful of which was developed and patented by the Danforth Company, is accepted among modern day seamen as the most reliable general purpose anchor presently known to the art. While only occasionally difficult to set due in part to the light weight for which it is named, its holding power and dependability for most purposes far exceeds that of other designs.

Unfortunately for the boating, yachting and shipping industries, the so-called "light weight" is not the most convenient of anchors to handle and stow. It has been replaced to a large exent, particularly on sail boats, by the plow (plough or "CQR") because the plow is more easily stowed on a pulpit or bow sprit and has no offensive projection such as the stock of the lightweight which might snag sails and the like. Even on power boats when the light weight is stowed, projecting over the bow as taught in U.S. Pat. Nos. 2,899,924; 3,865,065 or 3,635,187, there are stowage problems including forward and lateral projections which can and do complicate mooring, maneuvering, etc. When the light weight is stowed on deck, as has been traditional, it presents serious handling problems. A 35–45 pound anchor is difficult to lift at arms length over the boat's gunwale and under its rail. The anchor also is a troublesome cause of mud or dirt on the deck and it monopolizes precious space. [Handling devices such as taught in U.S. Pat. No. 3,974,793 may solve handling problems but not the dirt and space problems.]

If it were practical to provide a handling and stowage device which did not involve nuisance projections, which did not monopolize essential space, which did not introduce mud or dirt onto the deck of vessels, and which was easy and safe to handle, such a device would constitute a significant advance in the art and achieve three objects of this invention.

A fourth and most important object of this invention is to provide a stowage and handling device for a readily usable anchor which can be placed on the stern side or transom of a vessel. Such stowage has many uses including emergency use to prevent stranding, dropping and setting a first anchor of a "Bahama moor" (otherwise known as the Ogg system) in windy or crowded anchorages, mooring the vessel with the bow to a beach, and fore and aft anchoring.

SUMMARY OF THE INVENTION

As stated above, the invention is a handling and stowage device for a swivel fluke-type anchor of a type having a shank and generally planar flukes. The device comprises a rotatable means, preferably a boom, having a first axis of rotation for receiving, holding and releasing the shank of the anchor and a rotatable anchor fluke-receiving, folding, holding and releasing means, preferably comprising a fluke tip diversion (back) plate which channeling guides, having a second axis of rotation which may be the same or substantially parallel to the first axis of rotation and in a position such that when the anchor is held in proper juxtaposition with the fluke-receiving means by the shank of the anchor on the boom, the fluke channeling guide and diversion plate can receive and secure the fluke portion of the anchor and fold the flukes in towards the shank, resulting in the anchor being secured in a substantially planar situation. In one preferred embodiment of the invention, the boom and the fluke receiving portion are mounted on the same or essentially the same axis of rotation (see FIG. 1). However, it is not necessary that the boom be on the same axis of rotation as the fluke receiving portion. It can just as functionally be mounted on a parallel axis of rotation, which axis may itself be fixed or rotating, as in a second preferred embodiment (see FIG. 6 where, as can be inferred on close inspection, boom 74 is mounted on backplate assembly arm 51 rather than the hinge mount for the backplate assembly). It is essential, however, that the axis of rotation of the boom be such as to provide the above described juxtaposition of fluke and fluke receiving means as well as the folded substantially planar configuration. As used herein with respect to axis of rotation of the boom and the fluke receiving portion, the phrase "the same axis of rotation" includes the same or any combination or parallel axes through which the above described juxtaposition can be obtained. This invention is particularly suitable for an overhanging slide or transom mounting. The anchor can be stowed in a position more or less flat against the sides of transom of the vessel and generally in a vertical as opposed to a horizontal plane.

Figure 6:
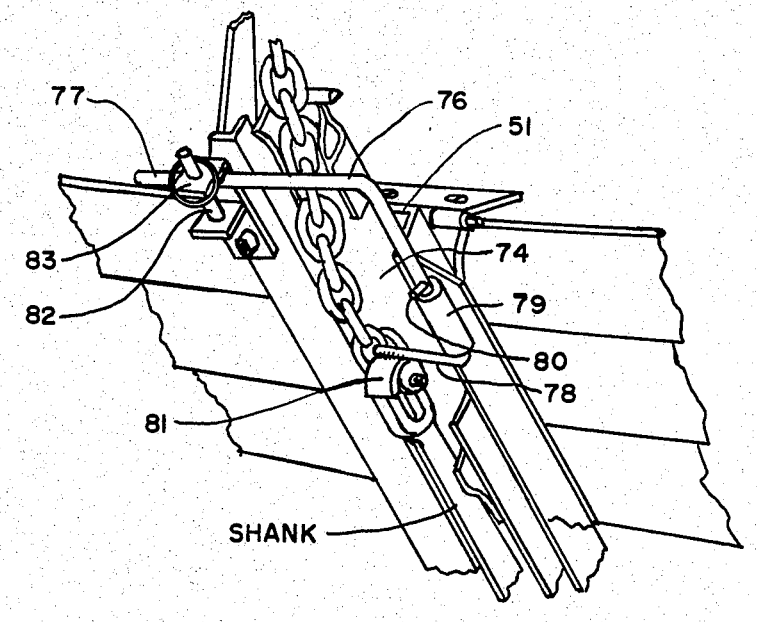
Figure 7:
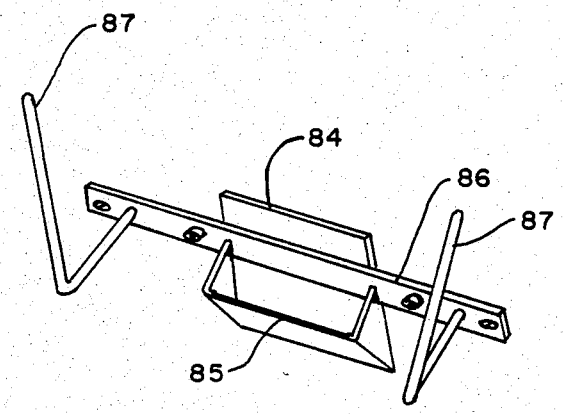

In the detailed description reference will be made to the drawing in which:

FIGS. 1–5 are perspective views of a preferred embodiment of this invention; and FIGS. 6–7 are perspective views of alternate sub assemblies of the same preferred embodiment. (See FIG. 6.)

Referring now to FIGS. 1–5, backplate assembly arm 51 and boom 74 are mounted on hinge mount 60 with hinge mounting bolt 53 which provides arm 51 and boom 74 with an identical axis or rotation. Backplate assembly arm 51 carries backplate 64 with fluke guides 63 and fluke stop 65 fixedly mounted on the outboard surface. At the top of backplate assembly arm 51 are bit arm holders 61 with bit arms 59 which are suitable for securing the rode or storing a short chain lead. Rigidly attached to the lower extension of bit arm holder 61, and in like manner to the inboard side of backplate 64, are locking arm sleeves 62 which house locking arm 67. Also (as shown on FIG. 3) on the inboard side of plate 64, and rigidly attached thereto is backplate locking arm 69. Locking arm 67 carries locking arm handle 66 at its upper extremity, and locking key 68 at its lower extremity. Also attached to the upper portion of backplate assembly arm 51 is pedal arm 58 and backplate raising pedal 57.

Boom 74 carries locking tab 54 with locking pin 73 (see FIG. 5), spring loaded guide 55 and fixed guides 56 which serve as fairleads for the rode as well as guides for the shank of the anchor. On the outer surface of boom 74 (best seen at FIG. 3) is shank restraint 52 which, as explained below, stops the shank temporarily in the upward direction.

Attached to the side of the vessel is gate latch 70 (FIG. 2) with lanyard 75 attached, which is located in such a manner as to engage backplate locking arm 69. Also attached to the side of the vessel is anchor stop 71 carrying anchor stop locking arm 72, a projection thereof.

In preparing the anchor for release, locking pin 73 is removed and locking arm handle 66 is turned so that locking key 68 is released from anchor stop locking arm 72. Lanyard 75 is pulled, releasing gate latch 70 and the entire assembly so that it swings out from the side of the vessel (FIG. 5) to the position shown at FIG. 4. The anchor is then released and the backplate assembly is returned to a position against the side of the vessel (FIG. 1) by foot pressure applied to pedal 57.

Figure 3:
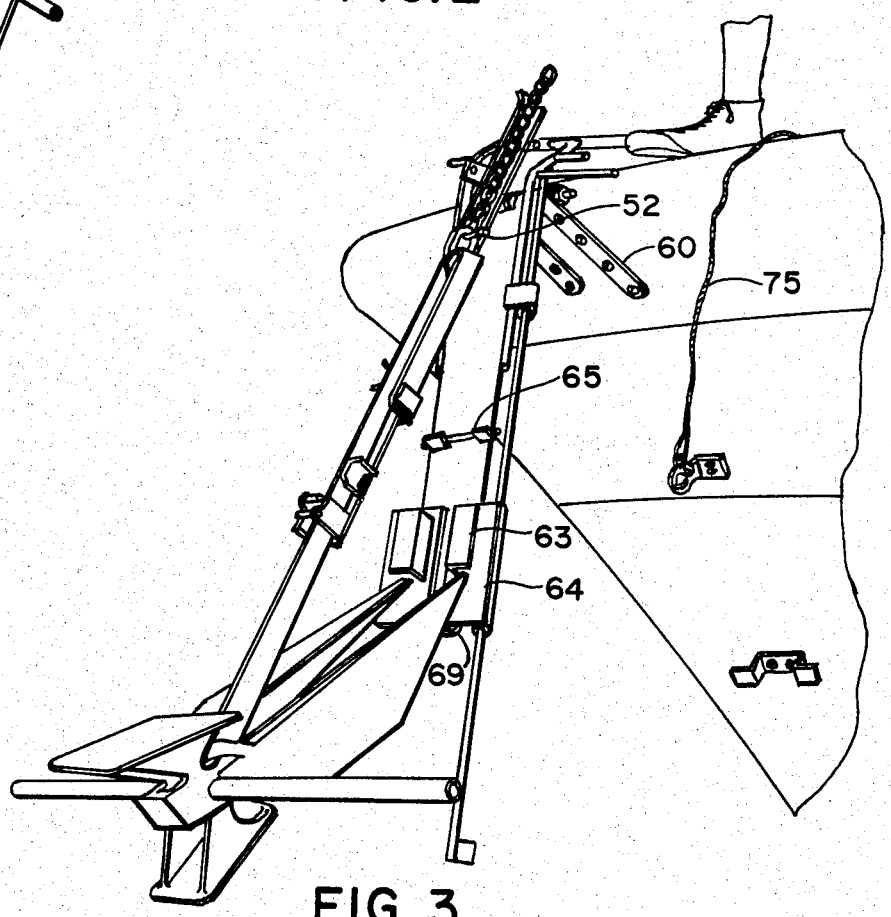
Figure 4:
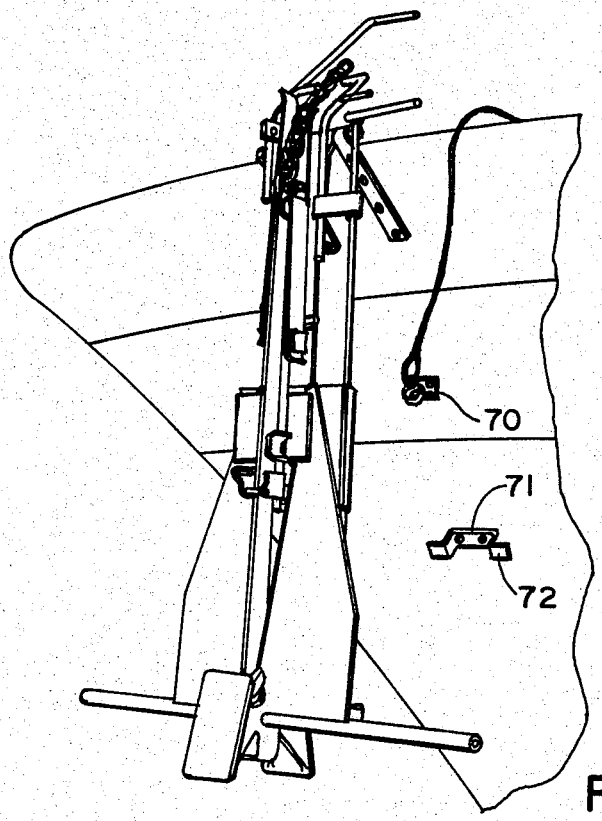
Figure 5:
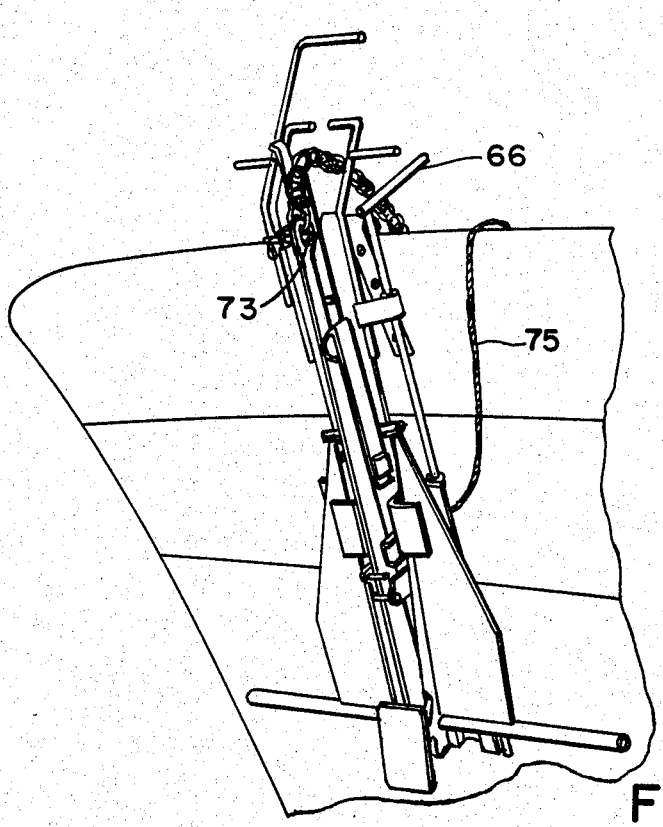

On recovery of the anchor, the shank of the anchor is brought onto the boom as shown at FIG. 1 to a position where the top of the anchor shank rests against shank restraint 52, at which point lanyard 75 is pulled, releasing backplate locking arm 69 from the backplate latch 70, so as to allow backplate 64 to fall towards the vertical position, engaging the tips of the flukes of the anchor, as shown at FIG. 1. With the tips of the flukes of the anchor against backplate 64, the operator applies pressure as shown at FIG. 3 in a downward thrust to backplate raising pedal 57. This in turn raises backplate 64 from the vertical position towards the horizontal in a direction away from the side of the vessel. When backplate 64 reaches a position approximately 30° from the vertical, pressure on the flukes of the anchor, exerted by the weight of the anchor, will cause the flukes to fold in as shown at FIG. 4 so that the anchor may be raised with the flukes being held in position between fluke guide 63 and backplate 64. The anchor is pulled up until it stops with the tips of the fluke against fluke stop 65 and with the flukes so embraced between fluke guides 63 and backplate 64, as to restrain independent movement of the anchor toward or away from the sides of the vessel and to require movement of the anchor with movement of the channel member guides 63 and backplate 64 towards or away from the sides of the vessel. At this point locking pin 73 may be replaced. By applying an outward pressure with the operator's foot against pedal 57, the entire assembly may then be swung to the position shown at FIG. 5 where backplate locking arm 69 engages backplate latch 70. Locking key 68 is then engaged behind anchor stop locking arm 72 by the operator's turning of locking arm handle 66.

In accordance with this invention the shank of the anchor is received along the boom while in a generally vertical position but preferably with the base of the shank inclined slightly (0°–45°) away from the side of the vessel. The tips of the flukes are received in the guides from the natural position of the flukes; and from this position the backplate diverts the flukes to a position whereby the flukes are generally coplanar with the shank. The anchor is then stowed with the flukes and the shank generally (±20°) in the same plane, generally coplanar (±30°) with the sides of the vessel and generally (±45°) in a vertical plane.

Referring now in detail to FIG. 6, an alternative axis of rotation is provided for the boom whereby boom 74 rotates on the upper extremity of backplate assembly arm 51, rather than coaxially with the backplate assembly as in FIGS. 1–5. FIG. 6 also shows an alternative locking for use in conjunction with the crown receiver shown at FIG. 7. The locking system comprises bolt lock 76 having a handle portion 77 and locking arm 78 which is axially mounted in bolt sleeve 79 affixed to back plate assembly arm 51. Pin 80 in bolt 76 prevents non axial movement. Locking arm 78 carries locking cradle 81 which when in the locked position bears against the upper portion of the shank. Handle portion 77 in the locked position is held in position by quick release pin 82 in the bolt lock receiver 83 which is also affixed to back plate assembly arm 51.

FIG. 7 shows a crown receiver which can be employed with the locking system shown at FIG. 6. Crown receiver assembly 84 comprises pouch-like crown receiver 85, mounting frame 86 and stock diverters 87.

For an improved sea-safe locking system, the locking assemblies shown in FIGS. 6 and 7 can be used in lieu of locking arm 67, locking key 68 and locking handle 66 along with anchor stop 71 and anchor stop locking arm 72. When so employed, it is necessary after recovery of the anchor, in order to stow the anchor when in the recovered co-planar position above described, to permit the anchor to fall so that the crown slides into the pouch of the crown receiver whereupon the locking assembly shown at FIG. 6 can be brought to bear on the upper portion of the shank. In releasing the anchor, locking pin 82 is removed and bolt 77 is released, permitting locking cradle 81 to fall away from the shank. Then the crown of the anchor is removed from crown receiver 85 by lifting the anchor by pulling on the rode or chain. When the crown is clear of the crown receiver, lanyard 75 can be pulled to release gate latch 70 for release of the anchor as previously described.

I claim:

1. A handling and storage device for a swivel fluke-type anchor having a shank and generally planar flukes for folding and storing the anchor generally vertically and parallel-planar to the side of a vessel having generally overhanging sides comprising in combination:

(a) an anchor shank receiving boom having an axis of rotation for receiving, holding and releasing the shank of the anchor;

(b) rotatable mounting means for the boom;

(c) a rotatable anchor fluke-receiving, folding, holding and releasing fluke embracing channeling member including a fluke tip diversion plate having a fluke receiving side and an opposite latching side, the member having the same axis of rotation as said shank receiving boom permitting movement in an arc generally from a first stowage and receiving position along the side of the vessel with the fluke receiving side facing away from the side of the vessel in which the flukes of an anchor with its shank resting on the boom will engage the fluke receiving side of the fluke tip diversion plate to a second outwardly extending collapse position extending generally perpendicular to its first position whereby while being moved to said second position and when the shank of the anchor is initially in a generally vertical position the flukes of the anchor being held in juxtaposition with (c) by (a) can be diverted from their natural gravity extended position by a first control force applied through the member, outwardly from the side of the vessel to the outwardly extending collapse position where, as the shank of the anchor approaches the horizontal, the gravitational force of the anchor itself against said fluke receiving side causes a collapse of the anchor into the embrace of the channeling member in a position with the flukes generally coplanar with the shank; and by applying a second control force around said axis of rotation exerted on the anchor through the embracing channeling member, drawing both boom-held shank and flukes generally parallel-planar and in close proximity to the side of the vessel the said first and second positions of said channeling member defining its operational limits being within an angle of no more than about 90°, (d) mounting means for mounting the rotatable channeling member permitting rotation of the channeling member in an arc, not exceeding the arc defined generally by the stowage position along and parallel to the side of the vessel and the collapse position generally perpendicular to and outboard of the side of the vessel, (e) control force receiving and transfer means for the channeling member whereby external rotational force may be applied to the channeling member and transmitted through the channeling member the anchor flukes as the first and second control force, and (f) latching means for catching and holding the latching side of the said channeling member when said channeling member is drawn to a position generally parallel planar with and in close proximity to the side of the vessel, and for releasing said channeling member.

2. The handling and stowage device of claim 1 wherein the anchor fluke receiving, folding, holding and releasing channeling member comprises said fluke tip diversion plate and channeling guides.

3. The handling and stowage device of claim 1 wherein the means for receiving, holding and releasing the shank is an anchor shank-receiving boom having fixed guides and at least one spring loaded guide.

4. The anchor handling and stowage device of claim 1 for an anchor further including a crown, the device further including a pouch shaped crown receiving and shank locking means.

* * * * *